US008478147B2

(12) United States Patent
Ichikawa

(10) Patent No.: US 8,478,147 B2
(45) Date of Patent: Jul. 2, 2013

(54) EXPOSURE TIMING DETERMINING METHOD AND IMAGE-FORMING APPARATUS

(75) Inventor: Hiroshi Ichikawa, Okazaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 345 days.

(21) Appl. No.: 12/554,378

(22) Filed: Sep. 4, 2009

(65) Prior Publication Data

US 2010/0061748 A1 Mar. 11, 2010

(30) Foreign Application Priority Data

Sep. 5, 2008 (JP) ..... 2008-228387

(51) Int. Cl.
*G03G 15/00* (2006.01)

(52) U.S. Cl.
USPC ..... 399/45; 399/51; 399/381

(58) Field of Classification Search
USPC ..... 399/45, 51
See application file for complete search history.

(56) References Cited

U.S. PATENT DOCUMENTS

| | | | | |
|---|---|---|---|---|
| 4,914,485 | A * | 4/1990 | Emori | 399/394 |
| 5,294,966 | A | 3/1994 | Shiokawa | |
| 6,032,014 | A * | 2/2000 | Janssens et al. | 399/270 |
| 6,343,202 | B1 * | 1/2002 | Kimura | 399/301 |
| 2005/0280698 | A1 * | 12/2005 | MacKenzie et al. | 347/251 |
| 2008/0019727 | A1 * | 1/2008 | Honma | 399/82 |
| 2009/0087237 | A1 * | 4/2009 | Sato | 399/381 |

FOREIGN PATENT DOCUMENTS

| | | | | |
|---|---|---|---|---|
| JP | H01-181680 | A | | 7/1989 |
| JP | 05-016468 | | | 1/1993 |
| JP | 05213469 | A | * | 8/1993 |
| JP | 10123880 | A | * | 5/1998 |
| JP | 2001-042743 | | | 2/2001 |
| JP | 2002052755 | A | * | 2/2002 |
| JP | 2003-035974 | A | | 2/2003 |
| JP | 2004-045611 | A | | 2/2004 |
| JP | 2004-302027 | | | 10/2004 |
| JP | 2004302027 | A | * | 10/2004 |
| JP | 2004-317806 | A | | 11/2004 |
| JP | 2006-015566 | | | 1/2006 |
| JP | 2007-017665 | A | | 1/2007 |
| JP | 2008-107686 | A | | 5/2008 |
| JP | 2008-164919 | | | 7/2008 |

OTHER PUBLICATIONS

Notice of Decision of Refusal for Japanese Patent Application No. 2008-228387 mailed Jan. 11, 2011.
Decision to Grant dated Jun. 7, 2011 in Japanese Application No. 2008-228387 and English translation thereof.
Notice of Reasons for Rejection in corresponding Japanese Application No. 2008-228387 mailed on Jul. 27, 2010.

* cited by examiner

*Primary Examiner* — David Gray
*Assistant Examiner* — Francis Gray
(74) *Attorney, Agent, or Firm* — Banner & Witcoff, Ltd.

(57) ABSTRACT

A toner image on a photosensitive drum exposed with an LED light beam radiated from an LED section and developed by an image-forming unit is transferred by an image-forming apparatus to a printing paper when the printing paper, which is fed from a paper feed tray or a manual feed tray and which is transported by a transport mechanism by a feeder section, passes through a process section. A control unit of the image-forming apparatus determines an exposure timing at which the LED section starts the exposure, depending on a supply source of the printing paper sheet to be subjected to the transfer by the process section. Therefore, the error of the photosensitive member arrival time, which is caused by the change of the transport route, is absorbed, and the deviation of the transfer start position, which results from the error, is suppressed.

3 Claims, 9 Drawing Sheets

Fig. 5

| PAPER TYPE | REGULAR PAPER | THIN PAPER | THICK PAPER | EXTRA THICK PAPER | ... |
|---|---|---|---|---|---|
| TRANSPORT SPEED $\gamma$ | $\gamma_0$ (STANDARD SPEED) | | $\gamma_1$ (HALF SPEED) | $\gamma_2$ (QUARTER SPEED) | ... |

※NOTE: $\gamma_2 < \gamma_1 < \gamma_0$

Fig. 7A

| SUPPLY SECTION | PAPER FEED TRAY | MANUAL FEED TRAY | ... |
|---|---|---|---|
| PAPER FEED MODIFICATION VALUE $\alpha$ | 0 (REFERENCE VALUE) | $\alpha_1 (< 0)$ | ... |

Fig. 7B

| TRANSPORT SPEED $\gamma$ | $\gamma_0$ (STANDARD SPEED) | $\gamma_1$ (HALF SPEED) | $\gamma_2$ (QUARTER SPEED) | ... |
|---|---|---|---|---|
| PAPER TYPE MODIFICATION VALUE $\beta$ | 0 (REFERENCE VALUE) | $\beta_1 (< 0)$ | $\beta_2 (< \beta_1)$ | ... |

Fig. 9

| PAPER TYPE | THIN PAPER | REGULAR PAPER | THICK PAPER | EXTRA THICK PAPER | ... |
|---|---|---|---|---|---|
| PAPER TYPE MODIFICATION VALUE $\beta$ | $\beta_3(>0)$ | 0 (REFERENCE VALUE) | $\beta_1(<0)$ | $\beta_2(<\beta_1)$ | ... |

EXPOSURE TIMING DETERMINING METHOD AND IMAGE-FORMING APPARATUS

CROSS REFERENCE TO RELATED APPLICATION

The present application claims priority from Japanese Patent Application No. 2008-228387, filed on Sep. 5, 2008, the disclosure of which is incorporated herein by reference in its entirety.

BACKGROUND OF THE INVENTION

1. Field of the Invention

The present invention relates to an exposure timing determining method for determining a timing at which the exposure is to be started for a photosensitive member such as a photosensitive drum, and an image-forming apparatus to which this method is applied.

2. Description of the Related Art

Conventionally, an image-forming apparatus is known, wherein a printing paper sheet (recording medium), which is supplied from any one of various trays, is transported by a transporting belt, while a developing agent such as a toner is electrostatically attracted to an electrostatic latent image formed on a photosensitive drum by performing the exposure, for example, with a laser beam so that a toner image on the photosensitive drum, which is formed by the exposure and the development as described above, is transferred to the recording medium disposed on the transporting belt, and thus an image is formed on the recording medium.

Usually, such an image-forming apparatus comprises resist rollers which feed the printing paper sheet subjected to the paper feeding in a direction in which the photosensitive drum is positioned, and a position sensor which detects the arrival of the printing paper sheet by means of a movable segment pushed out thereby, the movable segment having been arranged to interrupt the route for the printing paper sheet. The image-forming apparatus is constructed such that when the printing paper sheet, which has passed along the resist rollers, is detected by the position sensor, the exposure is started at a predetermined timing after the detection. A guide member, which guides the printing paper sheet fed from the resist rollers in the direction in which the photosensitive drum is positioned, is arranged together with the position sensor in the space (hereinafter referred to as "transport space") disposed between the resist rollers and the photosensitive drum.

In the case of such an image-forming apparatus, the difference arises in relation to the way or degree of warpage in the transport space, because the rigidity of the printing paper sheet differs due to the difference in the thickness of the printing paper sheet to be fed from any one of the various trays. As a result, the time (photosensitive member arrival time), which ranges from the passage of the printing paper sheet along the position sensor to the arrival at the photosensitive drum, is changed for every thickness of the printing paper sheet. The transfer position on the printing paper sheet is consequently deviated resulting from the difference in the photosensitive member arrival time.

In view of the above, an exposure timing-determining method is known, wherein the timing (hereinafter referred to as "exposure timing"), at which the exposure is to be started, is determined depending on the thickness of the printing paper sheet as the transfer objective, and thus the error, which relates to the arrival distance ranging from the sensor position for the printing paper sheet to the photosensitive drum (as well as the photosensitive member arrival time), is absorbed to adjust the transfer position on the printing paper sheet (refer to Japanese Patent Application Laid-open No. 2001-42743, for example).

However, in the case of the image-forming apparatus to which the conventional exposure timing-determining method is applied, even when the thickness of the printing paper sheet is identical, the deviation of the transfer position on the printing paper sheet sometimes exceeds an allowable range, for example, due to any other factor such as the transport route of the printing paper sheet. A problem arises in that such a situation is not considered.

SUMMARY OF THE INVENTION

In order to solve the problem as described above, an object of the present invention is to provide an exposure timing determining method which makes it possible to adjust the transfer position on the recording medium easily and appropriately, and an image-forming apparatus to which this method is applied.

According to a first aspect of the present invention, there is provided an exposure timing determining method for determining an exposure timing in an image-forming apparatus, the image-forming apparatus including an exposure section which forms an electrostatic latent image on a photosensitive member by exposing the photosensitive member at a predetermined exposure timing; a plurality of supply sections from each of which a recording medium is supplied to the photosensitive member; and a development and transfer mechanism which causes a developing agent to be electrostatically attracted to the electrostatic latent image formed by the exposure section, and which transfers the developing agent electrostatically attracted to the electrostatic latent image to the recording medium transported to the photosensitive member from each of the plurality of supply sections, the exposure timing determining method including: detecting a supply section, among the plurality of supply sections, from which the recording medium is supplied; and determining the predetermined exposure timing depending on the detected supply section.

In the exposure timing determining method of the present invention as mentioned above, the exposure timing is determined depending on the supply section which is the supply source of the recording medium subjected to the transfer by the development transfer mechanism. In other words, in the exposure timing determining method of the present invention, the exposure timing is variably set or established depending on the difference in the supply source of the recording medium to serve as the transfer objective, and thus the transfer start position on the recording medium is adjusted. Therefore, the deviation of the transfer start position is suppressed by absorbing the difference in time caused by the difference in the route along which the recording medium originating from any different supply source arrives at the photosensitive member. Consequently, it is possible to adjust the transfer position on the recording medium easily and appropriately.

According to a second aspect of the present invention, there is provided an image-forming apparatus which forms an image on a recording medium; including an exposure section which forms an electrostatic latent image on a photosensitive member by exposing the photosensitive member at a preset exposure timing; a plurality of supply sections from each of which a recording medium is supplied to the photosensitive member; a development and transfer mechanism which causes a developing agent to be electrostatically attracted to the electrostatic latent image formed by the exposure section, and which transfers the developing agent electrostatically attracted to the electrostatic latent image to the recording medium transported to the photosensitive member from each of the plurality of supply sections; and a timing-determining section which determines the exposure timing depending on a supply section, among the plurality of supply sections, from which the recording medium is supplied.

According to the second aspect of the present invention, the timing-determining section determines the exposure timing depending on the supply section of the recording medium subjected to the transfer by the development transfer mechanism. In other words, the image-forming apparatus of the present invention is the apparatus to realize the exposure timing-determining method as the first aspect of the present invention. Therefore, the effect, which is the same as or equivalent to the effect obtained when this method is carried out, can be obtained.

BRIEF DESCRIPTION OF THE DRAWINGS

FIG. 5 shows a table to illustrate the relationship between the paper type and the transport speed $\gamma$.

FIGS. 7A and 7B show tables to illustrate the paper feed modification value $\alpha$ and the paper type modification value $\beta$.

FIG. 9 shows a table to illustrate the paper type modification value $\beta$ in another embodiment.

DESCRIPTION OF THE PREFERRED EMBODIMENTS

An embodiment of the present invention will be explained below with reference to the drawings. In the following description, it is assumed that the left side as viewed in FIG. 1 resides in the frontward direction.

Figure 1:
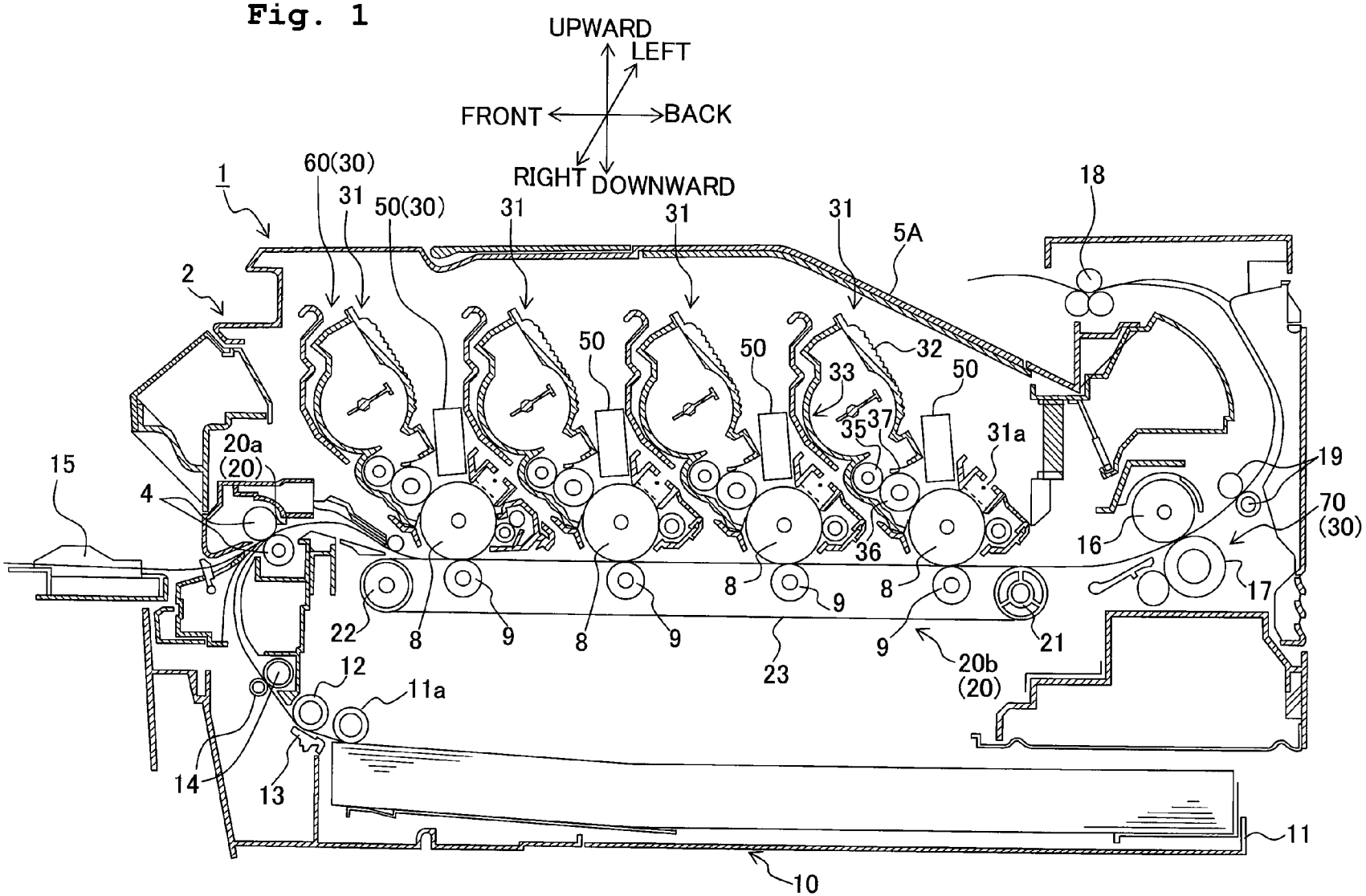
FIG. 1 shows a side sectional view illustrating a schematic arrangement of an image-forming apparatus to which the present invention is applied.

The image-forming apparatus 1 is a color image-forming apparatus based on the direct transfer tandem system, which comprises a substantially box-shaped casing 2 as shown in FIG. 1. A paper discharge tray 3, on which printing paper sheets (hereinafter simply referred to as "paper sheets" as well) are to be stacked as recording media after the image formation, is formed on the upper surface of the casing 2. A manual feed tray 15, which is usable to directly supply the printing paper sheet to the position of resist rollers 4 as described later on from the front side of the image-forming apparatus 1, is provided on the front surface of the casing 2.

Those accommodated in the casing 2 are a feeder section 10 which supplies the printing paper sheet in order to form the image, a transport mechanism 20 which transports the printing paper sheet supplied from the feeder section 10, an image-forming section 30 which performs the image formation on the printing paper sheet transported from the transport mechanism 20, and a control unit (timing-determining section) 40 (see FIG. 3) which drives and controls the respective sections.

The feeder section 10 comprises, for example, a paper feed tray 11 which is installed at the lowermost position of the casing 2 so that the paper feed tray 11 is capable of being drawn in the frontward direction and on which the printing paper sheets are stacked in order to form the image, a paper feed roller 11*a* which is arranged over or above the front end of the paper feed tray 11 and which transports the printing paper sheet, a separation roller 12 which takes out the printing paper sheet from the paper feed tray 11, a separation pad 13 which separates the printing paper sheet one by one by applying the transport resistance to the printing paper sheet taken out by the separation roller 12 from the paper feed tray 11, pitch rollers 14 which supplies the printing paper sheet fed from the space between the separation roller 12 and the separation pad 13 to the transport mechanism 20, and the manual feed tray 15 described above.

The transport mechanism 20 comprises an upstream mechanism 20*a* which is provided to transport the printing paper sheet supplied from the feeder section 10 in the backward direction, and a downstream mechanism 20*b* which is provided to transport the printing paper sheet transported from the upstream mechanism 20*a* in the image-forming section 30.

In particular, the downstream mechanism 20*b* comprises, for example, a driving roller 21 which is rotatable in cooperation with the operation of the image-forming section 30, a driven roller 22 which is arranged rotatably at the position separated from the driving roller 21, and a transporting belt 23 which is provided to span between the driving roller 21 and the driven roller 22.

The transporting belt 23 is driven by the driving roller 21 so that the transporting belt 23 is moved in a circulating manner in the clockwise direction as shown in FIG. 1. The printing paper sheet, which is placed on the upper surface of the transporting belt 23, is transported in the backward direction. A belt cleaner (not shown) is provided on the lower side of the downstream mechanism 20*b* in order to remove, for example, the paper powder and the toner adhered to the transporting belt 23.

Figure 2:
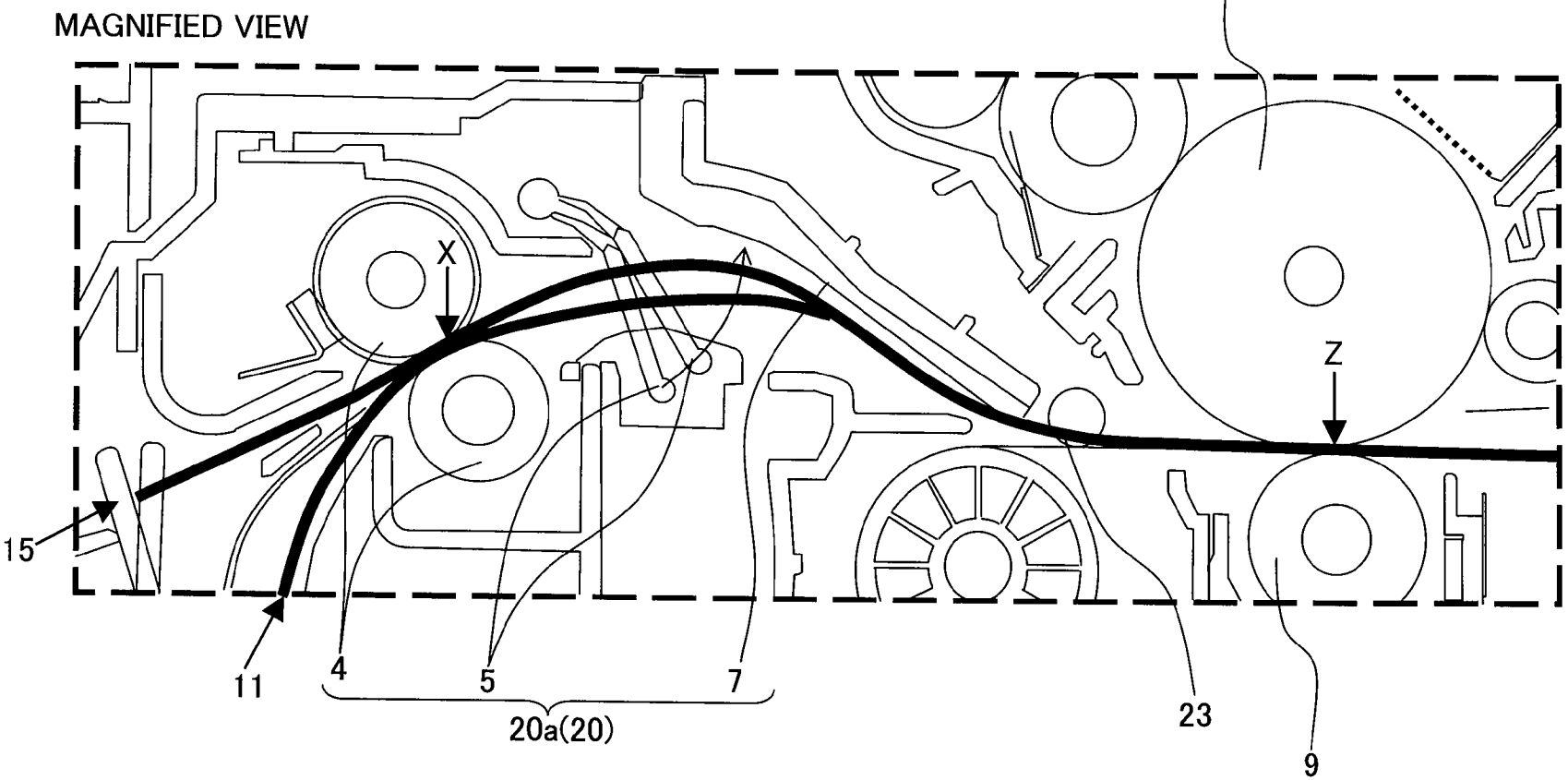
FIG. 2 shows a magnified sectional view to illustrate an upstream mechanism of the image-forming apparatus.

As shown in FIGS. 1 and 2, the upstream mechanism 20*a* comprises, for example, resist rollers 4 which are provided over or above the pitch rollers 14, a sensor (detecting mechanism) 103 which detects the arrival of the printing paper sheet when a plate-shaped movable segment 5 is pushed out, and a guide member 7 which guides the printing paper sheet allowed to pass along the movable segment 5 to the transfer position Z of the image-forming section 30 (to the nip position disposed between a photosensitive drum 8 and a transfer roller 9 as described later on to transfer the toner image on the photosensitive drum 8 to the printing paper sheet at the position).

In this embodiment, the supply route is the route for transporting the printing paper sheet from the paper feed tray 11 by the aid of the paper feed roller 11*a* until arrival at the resist rollers 4 or the route for transporting the printing paper sheet from the manual feed tray 15 until arrival at the resist rollers 4. The transport route is the route for transporting the printing paper sheet toward the photosensitive drum 8 from the start point of the resist rollers 4.

The movable segment 5 is arranged such that one end of the movable segment 5, which is parallel to the longitudinal direction of the cross section thereof, is rotatably supported, and a swingable portion, which is disposed on the other end side, obstructs the route (transport route) for the printing paper sheet fed from the resist rollers 4.

The resist rollers 4 are provided at the confluence position (i.e., the start position of the transport route) X at which the paper feed routes, which are different from each other depending on the supply sections (paper feed tray 11 or manual feed tray 15), join or flow together. The resist rollers 4 are composed of a pair of columnar rollers which have mutual rolling surfaces allowed to make contact under pressure and which are rotatable at the same speed or velocity in the opposite directions (while being opposed to one another). The resist rollers 4 are constructed such that the printing paper sheet is fed toward the transfer position Z of the image-forming section 30 while being pressed by the pair of rollers.

It is desirable that the transport speed of the printing paper sheet should be identical on the mutual rollers between the resist rollers 4 and the photosensitive drum 8. However, any dispersion appears for each of the rollers in relation to the shape on account of the processing and the forming in the actual production. Therefore, it is difficult to provide the identical transport speed on each of the rollers. If the transport speed on the photosensitive drum 8 is faster than the transport speed on the resist rollers 4, then the printing paper sheet is mutually pulled between the rollers, and any deviation appears in the transport speed on the transporting belt 23. As a result, any deviation (including the color deviation) arises in relation to the image formation position on the printing paper sheet. Therefore, in order to avoid the deviation in relation to the image formation position as described above, the transport speed on the resist rollers 4 is previously set to be slightly faster than the transport speed on the photosensitive drum 8.

The guide member 7 is arranged obliquely downwardly on the downstream side on the transport route so that the printing paper sheet, which is fed from the resist rollers 4, is guided to the transporting belt 23 (consequently to the photosensitive drum 8 as described later on). The printing paper sheet is warped due to the difference in the transport speed between the resist rollers 4 and the photosensitive drum 8 described above in the zone (hereinafter referred to as "transport space") ranging from the resist rollers 4 to the transfer position Z of the image-forming section 30. Therefore, the guide member 7 is arranged at the position and at the angle capable of securing the transport space which is sufficient to absorb the warpage of the printing paper sheet as described above.

The transport space herein refers to the space which is sufficiently adaptable to the difference in the way of warpage of the printing paper sheet, because the way of warpage of the printing paper sheet changes depending on the type of the printing paper sheet (i.e., the rigidity of the printing paper sheet) and the angle of insertion (as well as the paper feed source) of the printing paper sheet with respect to the position of contact under pressure of the rollers (i.e., the start position X) in relation to the resist rollers 4.

The angle of insertion herein refers to the angle for which the side in the gravity direction (downward side) is positive with respect to the tangential direction of the roller at the start position X. The larger the angle of insertion is, the longer the transport route in the transport space is. In the upstream mechanism 20*a* of this embodiment, the printing paper sheet, which is supplied along with the paper feed route different for each of the supply sections (paper feed tray 11 or manual feed tray 15) as the supply sources of the printing paper sheets, is transported to the transfer position Z via the transport route in conformity with the paper feed route. Therefore, the transport route is longer when the supply source is the paper feed tray 11 as compared with when the supply source is the manual feed tray 15.

As shown in FIG. 1, the image-forming section 30 comprises, for example, LED sections (exposure sections) 50 which form electrostatic latent images on the surfaces of the photosensitive drums 8, process sections (development transfer mechanisms) 60 which develop, with the toners as the developing agents, the electrostatic latent images formed by the LED sections 50 and which transfer the developed images to the printing paper sheet transported by the transport mechanism 20, and a fixing section 70 which fixes the images transferred by the process sections 60.

In particular, the process sections 60 include four image-forming units 31 described later on, and the transfer rollers 9 which are arranged opposingly to the photosensitive drums 8 possessed by the image-forming units 31 (the transfer rollers 9 being arranged under or below the photosensitive drums 8 with the transporting belt 23 intervening therebetween) and which press the printing paper sheet against the photosensitive drums 8.

The image-forming units 31 comprise, for example, the photosensitive drums 8 which are arranged in the transport direction of the transporting belt 23 to make contact with the transporting belt 23 respectively, chargers 31*a* which are provided for the photosensitive drums 8 respectively to charge the photosensitive drums 8, and developing cartridges 32.

The charger 31*a* is arranged opposingly to the photosensitive drum 8 at the position disposed obliquely upwardly on the back side of the photosensitive drum 8, while providing a predetermined spacing distance therebetween so that the charger 31*a* does not make contact with the photosensitive drum 8. The charger 31*a* uniformly charges the surface of the photosensitive drum 8 to provide the positive polarity by generating the corona discharge. The transfer bias is applied between the transfer roller 9 and the photosensitive drum 8 to allow a predetermined amount of the transfer current to flow.

The developing cartridge 32 is well-known, which comprises, for example, a toner-accommodating chamber 33, a supply roller 35, a developing roller 36, and a layer thickness-regulating blade 37. The developing cartridges 32 accommodate the toners (in particular, positively chargeable non-magnetic one-component toners) of different colors for the respective cartridges (black K, yellow Y, magenta M, and cyan C as referred to from the upstream side in the transport direction of the transporting belt 23).

On the other hand, the LED section 50 is well-known, which performs the exposure by using LED (not shown). The LED section 50 is constructed such that the surface of each of the corresponding photosensitive drums 8 is subjected to the high speed scanning at the timing and at the radiation speed in accordance with the control instruction by means of LED of each of the colors on the basis of the control instruction and the image data inputted from the control unit 40 (see FIG. 3).

In the process section 60 and the LED section 50 constructed as described above, the toner, which is released from the toner-accommodating chamber 33, is supplied to the developing roller 36 in accordance with the rotation of the supply roller 35. The toner is frictionally charged or subjected to the frictional electrification positively between the supply roller 35 and the developing roller 36. Further, the toner, which is supplied onto the developing roller 36, enters the space between the layer thickness-regulating blade 37 and the developing roller 36 in accordance with the rotation of the developing roller 36. The toner is sufficiently subjected to the frictional electrification at this place, and the toner is carried on the developing roller 36 as a thin film having a constant thickness.

The surface of the photosensitive drum 8 is firstly positively charged uniformly by means of the charger 31*a* during the rotation. After that, the surface of the photosensitive drum 8 is exposed by the LED section 50 to form the electrostatic latent image corresponding to the image to be formed on the printing paper sheet. Subsequently, in accordance with the rotation of the developing roller 36, the toner, which is carried and positively charged on the developing roller 36, is supplied to the electrostatic latent image formed on the surface of the photosensitive drum 8 upon the contact with the photosensitive drum 8 while being opposed thereto. Accordingly, the electrostatic latent image on the photosensitive drum 8 is converted into the visible image. The toner image, in which the toner is adhered to only the exposed portion, is carried on the surface of the photosensitive drum 8.

After that, the toner images, which are carried on the surfaces of the respective photosensitive drums 8, are successively transferred to the printing paper sheet by means of the transfer current described above when the printing paper sheet, which is transported by the transporting belt 23, passes through the spaces between the photosensitive drums 8 and the transfer rollers 9. The printing paper sheet, to which the toner images of the respective colors have been transferred in the overlaid or superimposed manner as described above, is subsequently transported to the fixing section 70.

The fixing section 70 comprises, for example, a heating roller 16 which is arranged on the side of the printing surface of the printing paper sheet and which transports the printing paper sheet while heating the toners having been transferred to the printing paper sheet, and a pressing roller 17 which is arranged on the side opposite to the heating roller 16 with the printing paper sheet intervening therebetween and which presses the printing paper sheet against the heating roller 16. The fixing section 70 is constructed so that the toners, which have been transferred to the printing paper sheet, are heated, melted, and fixed. The printing paper sheet, which has passed along the fixing section 70, is further transported by transport rollers 19, and the printing paper sheet is discharged to the paper discharge tray 3 by the aid of paper discharge rollers 18.

In other words, when the printing paper sheet, which is transported from the feeder section 10 by the transport mechanism 20, passes through the process section 60, the image-forming section 30 transfers, to the printing paper sheet, the toner image on the photosensitive drum 8 exposed with the LED light radiated from the LED section 50 and developed by the image-forming unit 31. Further, when the printing paper sheet 70 passes through the fixing section 70, the toner image, which has been transferred to the printing paper sheet, is fixed to the printing paper sheet by the fixing section 70.

Figure 3:
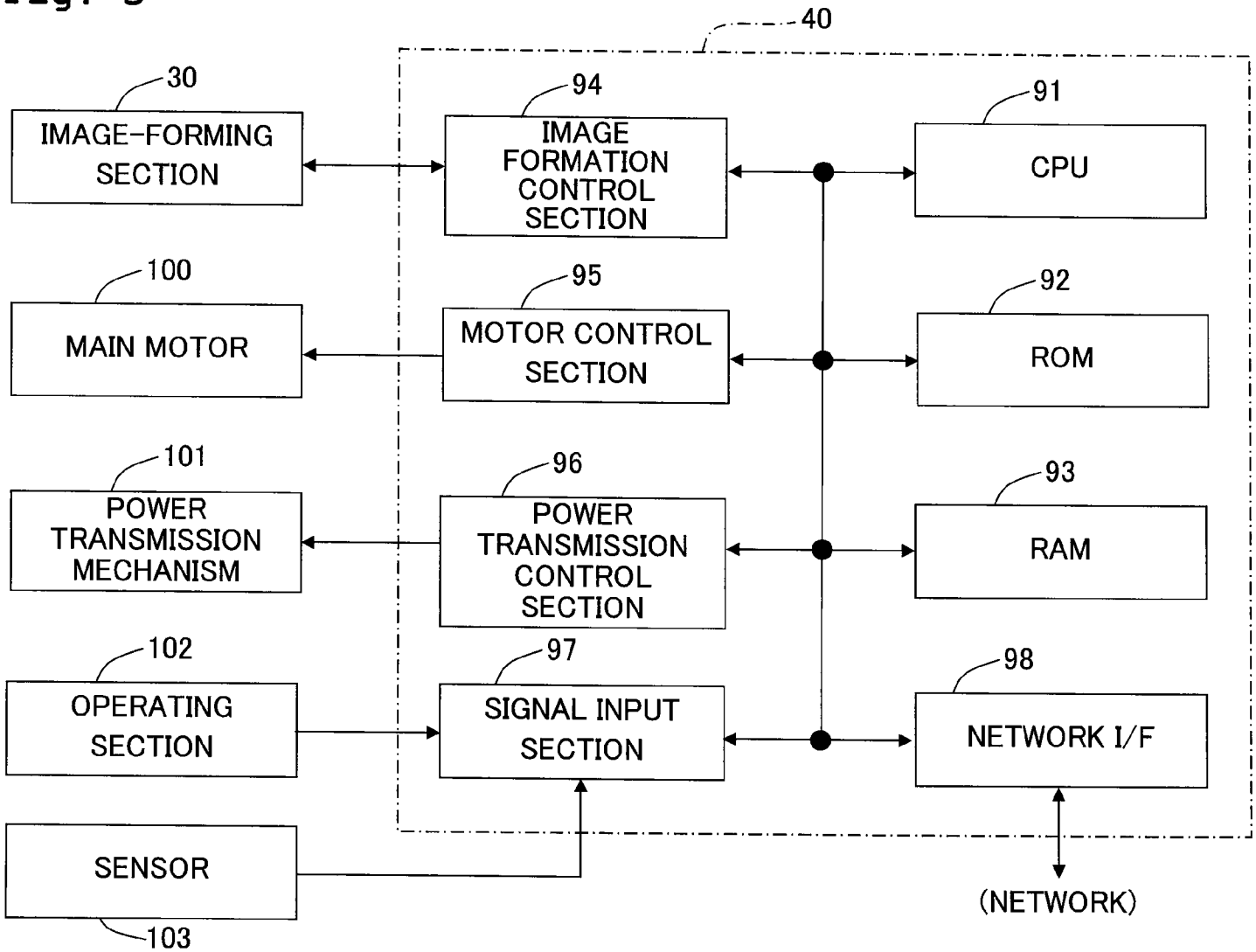
FIG. 3 shows a schematic block diagram illustrating the arrangement of parts or components concerning the present invention, of a control unit of the image-forming apparatus.

As shown in FIG. 3, the control unit 40 controls, for example, a main motor 100 which serves as the power source for the printing paper sheet transport system and the exposure and development system of the image-forming apparatus 1 (feeder section 10, transport mechanism 20, image-forming section 30), and a power transmission mechanism 101 which transmits the power from the main motor 100 to the drive shafts of various rollers provided for the image-forming apparatus 1 and which performs the connection, the disconnection, and the speed change for the power.

The control unit 40 performs the control in accordance with the instruction from a user to be inputted by the aid of an operating section 102 or the instruction from various information processing apparatuses (for example, a personal computer) to be inputted via the network. The control unit 40 is composed a well-known microcomputer principally comprising CPU 91, ROM 92, RAM 93, and a bus line for connecting the respective components. However, various corresponding tables described later on are stored in ROM 92 together with various programs.

The control unit 40 also comprises an image formation control section 94 which controls the image-forming section 30 in accordance with the instruction from CPU 91, a motor control section 95 which drives the main motor 100, a power transmission control section 96 which controls the power transmission mechanism 101, a signal input section 94 which inputs or incorporates, into the control unit 40, the instruction signal supplied from the user to be inputted by the aid of the operating section 102 and the detection signal supplied from sensors 103 (including the sensor of the upstream mechanism 20*a*) arranged at respective places of the image-forming apparatus 1, and a network interface (network I/F) 98 which performs the data communication with respect to the external information processing apparatus via the network. The respective sections or components are connected to CPU 91, ROM 92, and RAM 93 via the bus line.

In particular, the power transmission control section 96 performs the speed change control for the rotation speed while controlling the ON/OFF operation of the driving in relation to the various rollers of the printing paper sheet transport system (hereinafter referred to as "printing paper sheet transport system rollers") including, for example, the separation roller 12, the pitch rollers 14, the resist rollers 4, the driving roller 21, the heating roller 16, and the discharge rollers 18 and the various rollers of the exposure and development system (hereinafter referred to as "exposure and development system rollers") including, for example, the supply rollers 35, the developing rollers 36, the photosensitive drums 8, and the transfer rollers 9, on the basis of the control instruction to indicate the transport speed γ inputted from CPU 91.

The image formation control section 94 allows the LED section 50 and the process section 60 to transfer the toner image to the printing paper sheet on the basis of the printing data as described later on. The image formation control section 94 controls the timing at which the exposure is started for each of the four photosensitive drums 8 on the basis of the control instruction to indicate the exposure timing T inputted from CPU 91 (described later on) and the detection result obtained by the sensor 103 of the upstream mechanism 20*a*. The image formation control section 94 controls the radiation speed of the LED light on the basis of the control instruction to indicate the transport speed γ inputted from CPU 91.

CPU 91 executes the following image formation process on the basis of the program stored in ROM 92. Further, CPU 91 judges whether or not the toner exhaustion arises and/or the paper clog-up (printing paper sheet jam) arises on the paper feed route and/or the transport route during the image formation in accordance with the detection result obtained by the sensor 103. When the printing paper sheet jam and/or the toner exhaustion is detected, it is judged that the error to prohibit the image formation is caused. CPU 91 executes, for example, the process for stopping the operation of the image-forming section 30 to prohibit the image formation operation.

The image formation process executed by CPU 91 of the control unit 40 is started when the printing request is received from the external information processing apparatus via the network I/F 98.

Figure 4:
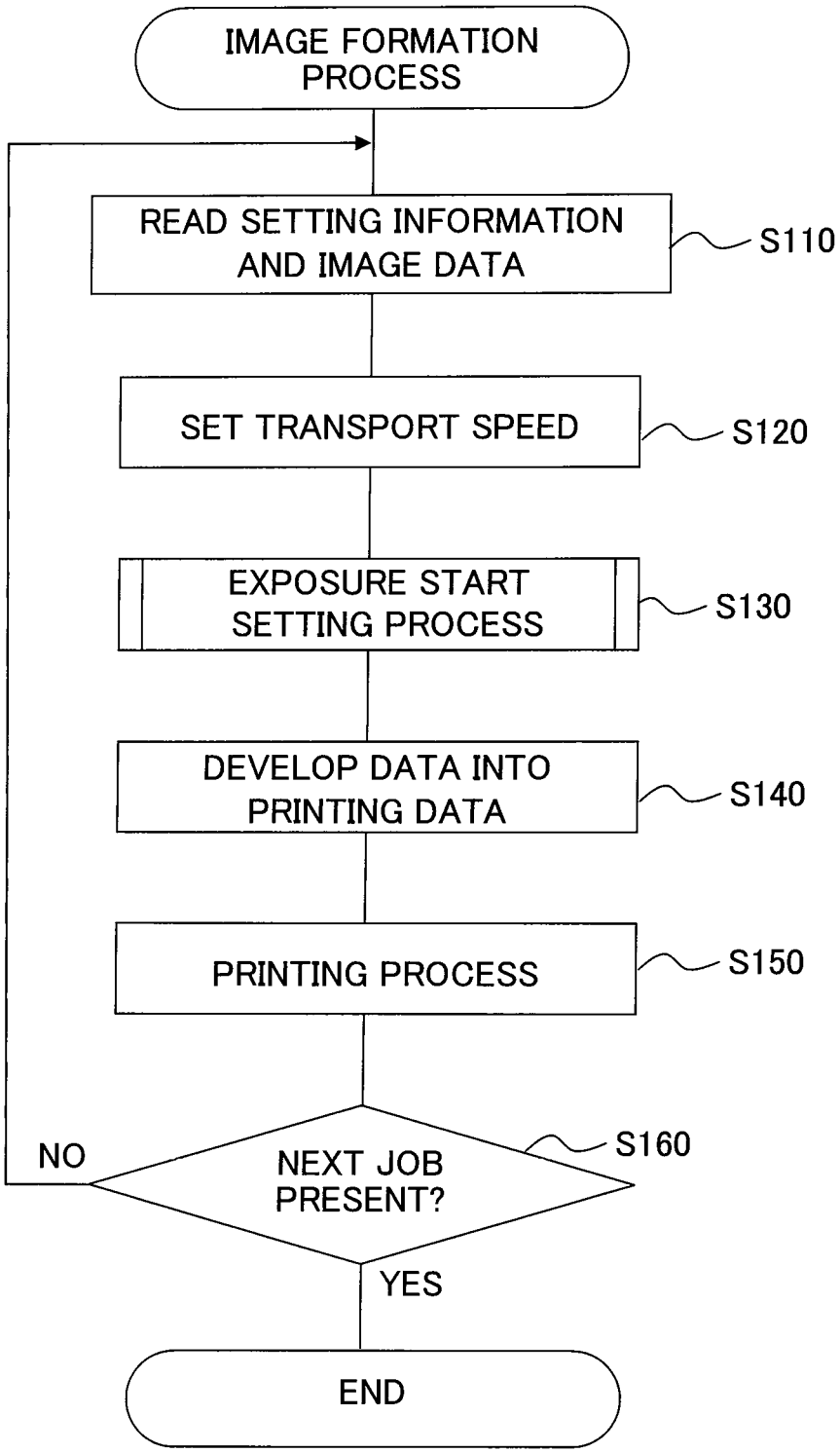
FIG. 4 shows a flow chart illustrating details of an image formation process executed by CPU of the control unit.

As shown in FIG. 4, when this process is started, a process is firstly executed in S110 to read, in a job unit from an unillustrated receiving buffer, the image data as the objective of the printing request (hereinafter referred to as "objective image data") and the setting information to indicate the type of the printing paper sheet (for example, regular paper, thin paper, thick paper, or extra thick paper) and the paper feed source (for example, manual feed or cassette) instructed by a user, on the basis of the printing request received via the network I/F 98. In this case, the printing request includes information about, for example, the number of required pages (i.e., the number of printing paper sheets) to print the data of all of the objective images in one job, and the page number corresponding to the objective image data read in this procedure.

In S120, a process is executed to set the transport speed $\gamma$ in conformity with the type (paper type) of the printing paper sheet on the basis of the setting information received in S110. The transport speed $\gamma$ refers to the speed or velocity at which the printing paper sheet is transported on the transporting belt 23. As shown in FIG. 5, the transport speed $\gamma$ is set to the standard speed $\gamma_0$ when the printing paper sheet is the regular paper or the thin paper. When the printing paper sheet is the thick paper, the transport speed $\gamma$ is set to the speed (hereinafter referred to as "half speed") $\gamma_1$ which is slower than the standard speed $\gamma_0$. When the printing paper sheet is the extra thick paper, the transport speed $\gamma$ is set to the speed (hereinafter referred to as "half half speed" or "quarter speed") $\gamma_2$ which is slower than the half speed $\gamma_1$. In other words, in this procedure, the transport speed $\gamma$ is variably set or established, and thus the fixing time (heating time for the toner), which is allowed to elapse in the fixing section 70, is more prolonged when the thickness of the printing paper sheet is larger. It is also possible to make the construction such that the transport speed $\gamma$ is variably set depending on the rigidity of the printing paper sheet without using the thickness of the printing paper sheet.

In S130, an exposure start setting process (described later on) is executed to set the timing (hereinafter referred to as "exposure timing") T at which the exposure is started with the LED section 50, on the basis of the setting information received in S110 and the transport speed $\gamma$ set in S120.

In S140, a process is executed to develop the objective image data read in S110 into (to generate) the printing data of the bitmap format. In this procedure, the objective image data is exemplified by the data (PDL data) described in the descriptive language such as PostScript and the data (BM data) in which the PDL data has been already developed in the bitmap format by means of the external information processing apparatus. In the case of the latter, the objective image data is used as it is as the printing data.

In a printing process in S150, the main motor 100 is driven by the aid of the motor control section 95, and the instruction and the data, which are based on the processes performed in S110 to S140, are outputted to the image formation control section 94 and the power transmission control section 96. Accordingly, a driving instruction process is executed, in which the toner image is transferred onto the printing paper sheet while transporting the printing paper sheet. When the objective image data, which corresponds to an amount of a plurality of pages, is present in one job, the printing is performed in the amount of the plurality of pages.

Specifically, the control instruction is outputted to the power transmission control section 96 in order to drive (rotate) the transport system rollers at the transport speed $\gamma$ set in S120. Further, the control instruction is outputted to the image formation control section 94 in order to perform the exposure with the printing data generated in S140 at the radiation speed previously set in conformity with the transport speed $\gamma$ and the exposure timing T set in S130.

In this procedure, when the printing is completed for all of the objective image data included in one job, it is judged in subsequent S160 whether or not the next job is present. In the case of the negative judgment, the present process comes to an end. In the case of the affirmative judgment, the routine returns to S110 to execute the process for the next job in the same manner as described above.

Figure 6:
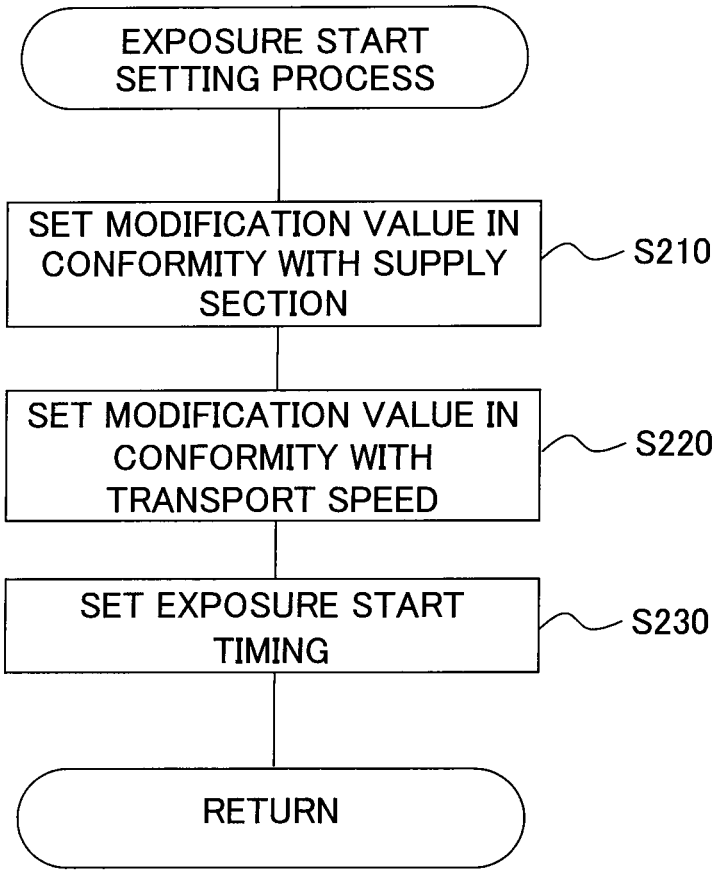
FIG. 6 shows a flow chart illustrating details of an exposure start setting process executed in the image formation process.

As shown in FIG. 6, when the exposure start setting process executed in S130 of the previous image formation process is started, then reference is firstly made in S210 to a correspondence table (hereinafter referred to as "paper feed correspondence table"; third correspondence table) in which the correspondence is established one-to-one between the supply section and the modification value (hereinafter referred to as "paper feed modification value") $\alpha$ of the exposure timing T as shown in FIG. 7A on the basis of the setting information read in S110 of the previous image formation process, and the paper feed modification value $\alpha$, which is adapted to the supply section, is set. In this embodiment, the paper feed modification value $\alpha$ is set to the reference value (zero) when the supply section is the paper feed tray 11. When the supply section is the manual feed tray 15, the paper feed modification value $\alpha$ is set to the value $\alpha_1$ ($\alpha_1<0$) which is smaller than the reference value.

In S220, reference is made to a correspondence table (hereinafter referred to as "speed correspondence table"; second correspondence table) in which the correspondence is established one-to-one between the transport speed $\gamma$ and the modification value (hereinafter referred to as "paper type modification value") $\beta$ of the exposure timing T as shown in FIG. 7B on the basis of the transport speed $\gamma$ set in S120 of the previous image formation process, and the paper type modification value $\beta$, which is adapted to the transport speed $\gamma$ (and consequently adapted to the type of the printing paper sheet), is set. In this embodiment, the paper type modification value $\beta$ is set to the reference value (zero) when the transport speed $\gamma$ is the standard speed $\gamma_0$. When the transport speed $\gamma$ is the half speed $\gamma_1$, the paper type modification value $\beta$ is set to the value $\beta_1$ which is smaller than the standard value ($\beta_1<0$). When the transport speed $\gamma$ is the quarter speed $\gamma_2$, the paper type modification value $\beta$ is set to the value $\beta_2$ which is smaller than the value $\beta_1$ ($\beta_2<\beta_1$).

In S230, the exposure timing T is calculated (set or established) in accordance with the following expression (1) by using the parameters of the paper feed modification value $\alpha$ set in S210, the paper type modification value $\beta$ set in S220, the transport speed $\gamma$ set in S120, and the start timing previously set to serve as the reference (hereinafter referred to as "reference start timing") $T_0$, and the standard speed $\gamma_0$, and the process comes to an end.

$$T=(T_0+\alpha+\beta)\times\gamma_0/\gamma \quad (1)$$

In this embodiment, the exposure timing T and the reference start timing $T_0$ are represented by the timing based on the timing or time point of the printing paper sheet detection by the sensor 103 of the upstream mechanism 20*a* (i.e., the time ranging from the detection by the sensor 103 to the exposure start by the LED section 50). In particular, the reference start timing $T_0$ is previously set by means of, for example, an experiment. The reference start timing $T_0$ is represented by the time required from the time point of the detection of the printing paper sheet by the sensor 103 of the upstream mechanism 20*a* until the blank space portion is constant on the printing paper sheet after the image formation, when the regular paper sheet (or the thin paper sheet), which is supplied from the paper feed tray 11, is transported at the standard speed $\gamma_0$ on the transport route.

In other words, the expression (1) means the fact that the modification of the time difference caused by the difference in the transport speed $\gamma$ ($=T_0\times\gamma_0/\beta$; hereinafter referred to as "γ modification"), the modification of the time difference caused by the difference in the supply section ($=T_0+\alpha$; hereinafter referred to as "α modification"), and the modification of the time difference caused by the difference in the paper type ($=T_0+\beta$; hereinafter referred to as "β modification") are performed in relation to the difference in the time (hereinafter referred to as "photosensitive member arrival time") required for the printing paper sheet to arrive at the transfer position Z on the photosensitive drum 8 from the detection position of the sensor 103 of the upstream mechanism 20*a*.

Figure 8:
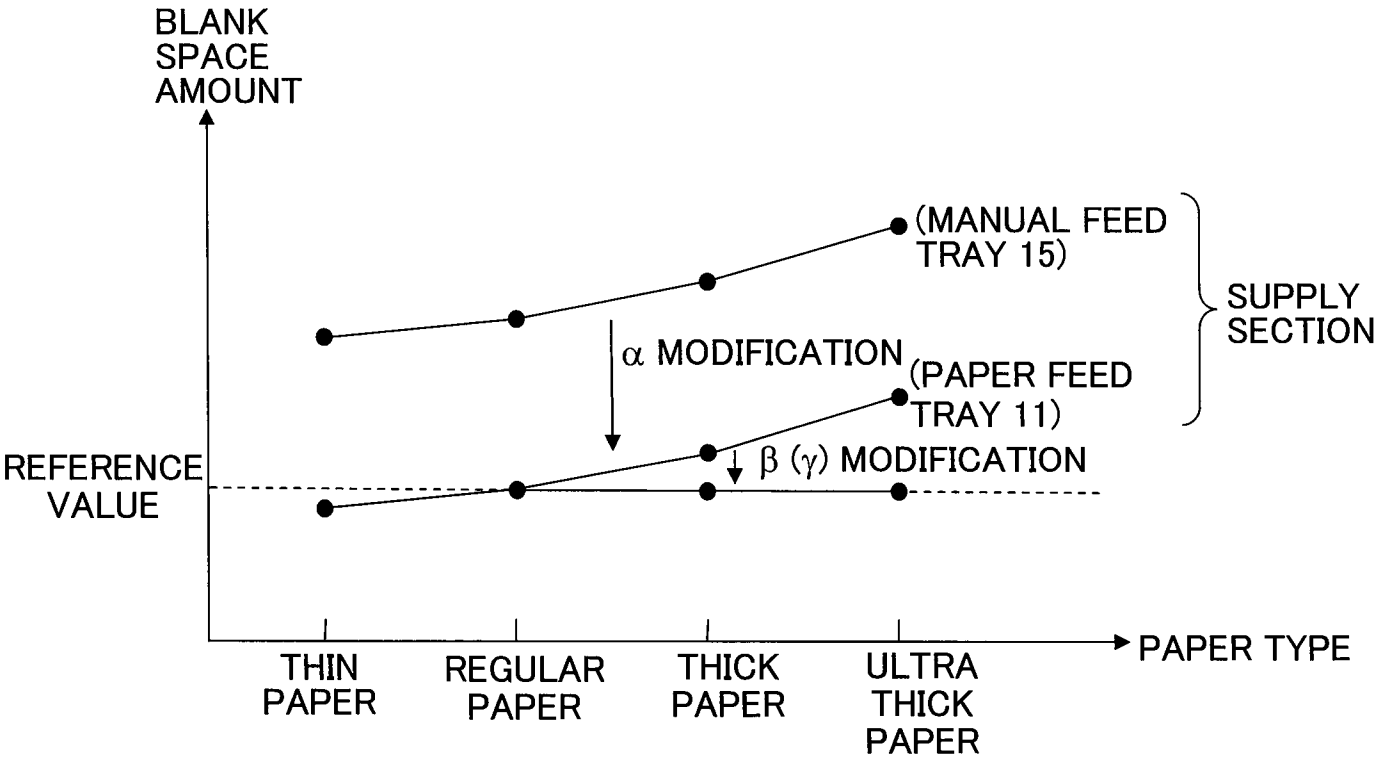
FIG. 8 shows a graph to illustrate the $\alpha$ modification and the $\beta$ modification.

In the image-forming apparatus 1 constructed as described above, as shown in FIG. 8, when the supply section is the manual feed tray 15, then the α modification is applied to the exposure timing, and thus the amount of the error, in which the photosensitive member arrival time is quickened as compared with when the supply section is the paper feed tray 11, is absorbed. Therefore, the transfer start position of the printing paper sheet (as well as the blank space amount) is equivalent to that provided when the supply section is the paper feed tray 11.

In the image-forming apparatus 1, when the paper type is the thick paper or the extra thick paper, then the β modification is applied to the exposure timing, and thus the amount of the error, in which the photosensitive member arrival time is quickened as compared with when the paper type is the regular paper, is absorbed. Therefore, the transfer start position of the printing paper sheet (as well as the blank space amount) is equivalent to that provided when the paper type is the regular paper. In this case, it is prescribed that the transport speed γ should be delayed in order to secure the fixing time. Therefore, when the γ modification is applied to the exposure timing, the amount of the time difference, in which the photosensitive member arrival time is delayed as compared with when the paper type is the regular paper, is also absorbed.

As explained above, in the image-forming apparatus 1 of this embodiment, the transfer start position on the printing paper sheet is adjusted by variably setting the exposure timing T depending on the paper type and the supply section as the supply source of the printing paper sheet as the objective of the image formation.

Therefore, according to the image-forming apparatus 1 of this embodiment, the exposure timing T is adjusted depending on the difference in the transport route of the printing paper sheet. Therefore, the error of the photosensitive member arrival time, which is caused by the change of the transport route, can be absorbed. Accordingly, the deviation of the transfer start position, which results from the error, can be suppressed. Consequently, it is possible to easily and appropriately adjust the transfer position on the printing paper sheet.

In the image-forming apparatus 1, the transport speed γ is set for each of the certain ranges of the thickness of the printing paper sheet in order to secure the fixing time, and the exposure timing T is set by using the speed correspondence table in which the correspondence is established one-to-one between the transport speed γ and the modification value (paper type modification value) β of the exposure timing T. In other words, the exposure timing T is determined by utilizing the existing control result. Accordingly, the deviation of the transfer position on the printing paper sheet can be suppressed to be within the allowable range, and the load on the control, which concerns the adjustment of the transfer position, can be mitigated.

In the image-forming apparatus 1, the exposure timing is set assuming that the reference start timing $T_0$ is provided when the regular paper is supplied from the paper feed tray 11. Therefore, in practice, it is enough that the exposure timing should be calculated only when any special printing paper sheet and/or any special supply section is/are set by the user. Consequently, it is possible to further mitigate the load on the control.

The embodiment of the present invention has been explained above. However, the present invention is not limited to the foregoing embodiment, which can be carried out in a variety of forms within the range without deviating from the gist or essential characteristics of the present invention.

For example, in the exposure start setting process of the embodiment described above, the speed correspondence table is used when the paper type modification value β is set. However, there is no limitation thereto. As shown in FIG. 9, it is also allowable to use a paper type correspondence table (corresponding to the first correspondence table) in which the correspondence is established one-to-one between the type of the printing paper sheet and the paper type modification value β.

In this case, the exposure timing T is variably set for each of the types of the printing paper sheets. It is possible to improve the adjustment accuracy for the transfer position on the printing paper sheet. Further, in the image formation process of the embodiment described above, the transport speed γ, which depends on the type of the printing paper sheet, is set to the half speed $\gamma_1$ in the case of the thick paper, or the transport speed γ is set to the quarter speed $\gamma_2$ in the case of the extra thick paper. However, there is no limitation thereto. For example, the transport speed γ may be unified into the half speed $\gamma_1$ or the quarter speed $\gamma_2$. Alternatively, the type of the printing paper sheet may be appropriately changed. It is also allowable to appropriately change the type of the printing paper sheet in the paper type correspondence table described above.

In the exposure start setting process of the embodiment described above, the exposure timing T is set depending on the supply section and the paper type. However, there is no limitation thereto. The exposure timing T may be set depending on at least the supply section.

In the exposure start setting process of the embodiment described above, the exposure timing T is calculated assuming that the reference start timing $T_0$ is provided when the regular paper is supplied from the paper feed tray 11. However, there is no limitation thereto. A correspondence table (timing correspondence table), in which the correspondence is established for the exposure timing T for each of the supply sections (and each of the paper types), may be previously stored, for example, in ROM 92, and the timing table may be used.

In the image formation process including the exposure start setting process of the embodiment described above, the transport speed γ and the exposure timing T are set in the job unit. However, there is no limitation thereto. The transport speed γ and the exposure timing T may be set in the page unit when the objective image data of a plurality of pages is included in one job.

The exposure start setting process of the embodiment described above is applied to the image-forming apparatus 1. However, there is no limitation thereto. The exposure start setting process may be applied to any other image-forming apparatus. For example, when the image-forming apparatus is provided with a plurality of paper feed trays, the exposure timing T may be determined for each of the paper feed trays.

What is claimed is:

1. An image-forming apparatus for forming an image on a recording medium, comprising:

an exposure section configured to form an electrostatic latent image on a photosensitive member by exposing the photosensitive member at a preset exposure timing;

a plurality of supply sections, wherein the image-forming apparatus is configured to supply recording media to the photosensitive member;

a development and transfer mechanism configured to cause a developing agent to be electrostatically attracted to the electrostatic latent image formed by the exposure section, and to transfer the developing agent electrostatically attracted to the electrostatic latent image to a recording medium transported to the photosensitive member from one of the plurality of supply sections;

a transport mechanism configured to transport the recording medium to the photosensitive member along supply routes which correspond to the plurality of supply sections respectively, and along a transport route with which the supply routes are connected, wherein the transport mechanism includes a resist roller section provided at a start position of the transport route and constructed of a pair of rollers, wherein the transport mechanism is configured to feed the recording medium by the pair of rollers, the pair of rollers having rolling surfaces which are brought into pressing contact with each other, and wherein the pair of rollers are rotatable at an identical speed; and a control unit configured to determine the exposure timing based on a supply section, among the plurality of supply sections, from which the recording medium is supplied, and further depending on a difference in an insert angle of the recording medium with respect to the resist roller section, wherein the difference in the insert angle of the recording medium is generated by a difference in the plurality of supply sections from which recording media are supplied, wherein the control unit is configured to determine the exposure timing so that as a thickness or rigidity of the recording medium is greater, the exposure is started earlier by the exposure section depending on a type of the recording medium on which the developing agent is transferred by the development and transfer mechanism, wherein the control unit is configured to determine the exposure timing by using a first table in which the type of the recording medium is related one-to-one to a first modification value for determining the exposure timing, and a second table in which a transport speed of the recording medium is related one-to-one to a second modification value for determining the exposure timing, and wherein the thickness and the rigidity of the recording medium includes predetermined ranges, wherein the transport speed of the recording medium to be transported to the photosensitive member is previously defined, for each of the predetermined ranges of the thickness or of the rigidity of the recording medium, so that the transport speed is slowed as the thickness or the rigidity of the recording medium is greater.

2. The image-forming apparatus according to claim 1, wherein the control unit is configured to determine the exposure timing by further using a third table, wherein the third table relates the supply section, among the plurality of supply sections, from which the recording medium is transferred by the development and transfer mechanism one-to-one to a third modification value for determining the exposure timing.

3. The image-forming apparatus according to claim 2, wherein the control unit is configured to calculate the exposure timing T in accordance with the following expression:

$$T=(T_o+\alpha+\beta)\times\gamma_o/\gamma, \text{ wherein } \gamma<\gamma_o$$

provided that $T_o$ and $\gamma_o$ represent a preset exposure timing and a preset transport speed, respectively, as references, $\gamma$ represents the transport speed defined by the thickness or the rigidity of the recording medium, $\alpha$ represents a modification value which is set depending on the supply section, among the first, second and third modification values for determining the exposure timing, and $\beta$ represents the first modification value which is set depending on the transport speed.

* * * * *